US005306016A

United States Patent [19]

McInnis

[11] Patent Number: 5,306,016

[45] Date of Patent: Apr. 26, 1994

[54] PACE BOARD GAME

[76] Inventor: James M. McInnis, 10070 W. Swan Rd., Odessa, Tex. 79763

[21] Appl. No.: 644,453

[22] Filed: Jan. 23, 1991

Related U.S. Application Data

[63] Continuation-in-part of Ser. No. 474,158, Mar. 12, 1990, abandoned.

[51] Int. Cl.[5] ..... A63F 3/02

[52] U.S. Cl. ..... 273/258; 273/260

[58] Field of Search ..... 273/260, 261, 258

[56] References Cited

U.S. PATENT DOCUMENTS

| | | | |
|---|---|---|---|
| 574,192 | 12/1896 | Climenson | 273/242 X |
| 604,401 | 5/1898 | Lang | 273/242 |
| 1,509,678 | 9/1924 | MacPherson et al. | 273/258 |
| 3,632,111 | 1/1972 | Wicks | 273/258 |
| 3,863,927 | 2/1975 | Moritz | 273/258 |
| 3,869,124 | 3/1975 | Stein et al. | 273/260 X |
| 3,929,337 | 12/1975 | Hayes | 273/260 X |
| 4,842,282 | 6/1989 | Sciarra | 273/258 |
| 4,883,277 | 11/1989 | Laisure | 434/188 X |

FOREIGN PATENT DOCUMENTS

| | | | |
|---|---|---|---|
| 3200087 | 7/1983 | Fed. Rep. of Germany | 273/258 |

*Primary Examiner*—William Stoll

[57] ABSTRACT

A method of playing a board game having rows and columns of squares and consecutively numbered playing tokens. A token may jump an opponent's token which is occupying an adjacent square forward, diagonally forward, or on the side of the token only if the number of the token and the number on the opponent's token multiply to an even number. The game is won by advancing the number ten token to the opponent's end of the board or by capturing the opponent's number ten token.

1 Claim, 1 Drawing Sheet

PACE BOARD GAME

RELATED APPLICATIONS

This is a continuation-in-part of application Ser. No. 07/474,158, now abandoned, filed on Mar. 12, 1990.

U.S. PATENT DOCUMENTS

| | | |
|---|---|---|
| 3869124 | 3-1975 | Stein et. al. Class 273 Subclass 260X |
| 3632111 | 1-1972 | Wicks Class 273 Subclass 258 |
| 1509678 | 9-1974 | MacPherson et. al. Class 273 Subclass 258 |
| 3863927 | 2-1975 | Moritz Class 273 subclass 258 |
| 4842282 | 6-1989 | Sciarra Class 273 Subclass 258 |
| 4883277 | 11-1989 | Laisire Class 434 Subclass 188x |
| 3929337 | 12-1975 | Hayes Class 273 Subclass 260x |
| 574192 | 12-1896 | Climenson Class 273 Subclass 242x |
| 604401 | 5-1898 | Lang Class 273 Subclass 242 |

BACKGROUND OF THE INVENTION

A) Field of the Invention

The game is an educational board game played by two (2) persons, in which the board has a playing surface formed into squares arranged into rows (horizontal) and columns (vertical) with numbered tokens therein for movement along segments in order to reach the opponents farthest end position by capturing even products and removing opponents tokens by these products. The final aim of the game is to be first to reach the opponents farthest end portion or base line with one's largest numbered token. Many board games are known in which chips or discs move along squares of game boards; however, none of the prior games have rules and goals as this PACE BOARD GAME OF MULTIPLICATION.

B) Description of the Prior Art

Not applicable.

SUMMARY

The Pace Board Game of Multiplication is a board game of strategy in which two players compete, in which multiplication determines each player's move or loss of token. It is the main goal and objective of this invention to win either: 1) By capturing opponent's Token Number 10 or 2) By landing your Token Number 10 on opponent's end of board.

BRIEF DESCRIPTION OF THE DRAWINGS

Brief Description of Pace Board Game of Multiplication Drawings

The invention will be more clearly understood with reference to the accompanying drawings herein:

Figure 1:
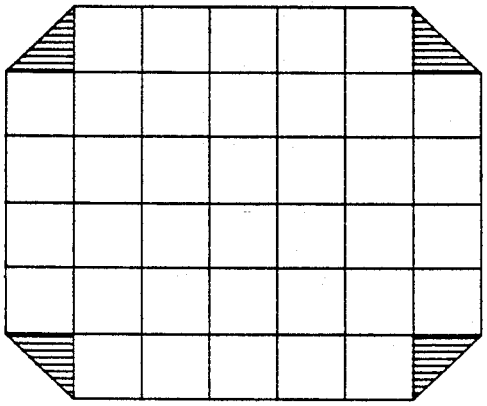
Figure 2:
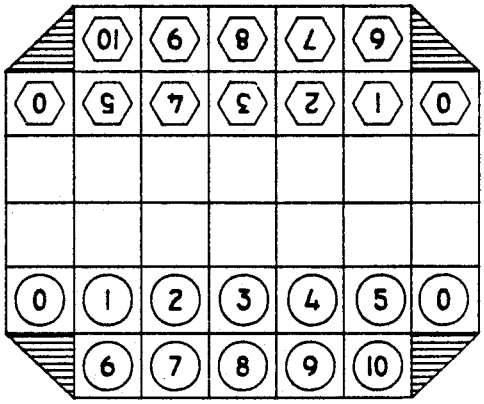
Figure 3:
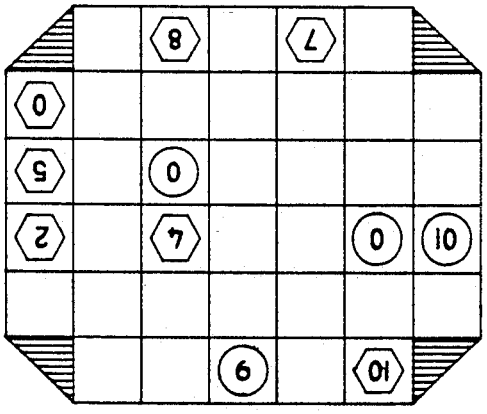
Figure 4:
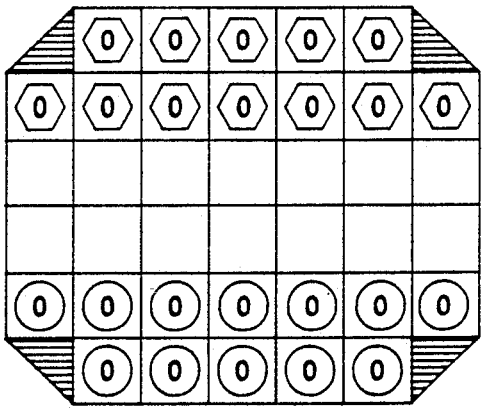

FIG. No. 1 is a pictorial plane view of the PACE GAME BOARD OF MULTIPLICATION.

FIG. No. 2 is a pictorial plane view of the game board of the present invention with the numbered tokens positioned on the squares of the game board at the start of the game.

FIG. No.3 is a pictorial plane view of the board of the present invention showing one example of a winning position, where the highest numbered token has reached the opponent's end of board.

FIG. No. 4 is a pictorial plane view of the game board of the present invention illustrating each of the token's back sides showing a "0" on each token.

DESCRIPTION OF THE PREFERRED EMBODIMENT(S)

In accordance with the rules of the game, the board is set-up in FIG. No. 2 of the drawings. The objective of the game is to advance your token number 10 so that it reaches the opponent's base row first and wins the game. The loss of your token number 10 causes you to lose the game. Tokens numbered 1, 2, 3, 4, and 5 move forward or diagonally one square per turn only and can not move backward, but can capture side-ways as well as forward and diagonally. Tokens numbered 6, 7, 8, and 9 can move sideways while on the base row one square per turn. Once these tokens have moved forward from the base row they must move forward diagonally (same as tokens 1 through 5) and can not move backwards, but can capture side-ways as well as forward or diagonally. Tokens "0" through 9 must capture; but, token 10 is not obligated to capture if it is in immediate danger of being captured. To capture an opponent's token, you must jump over their token or tokens whenever the product of the tokens equals an even product. The product of the multiplier and multiplicand must be an even number. An example of even numbered jumps are "0" times any number is "0" or $(2\times8=16)$ or $(6\times7=42)$ or $(9\times8=72)$ or $(8\times3=24)$ or $(10\times1=10)$. More than one jump can occur as long as the products equal an even number. As bonus, any tokens 1 through 9 reaching the opponent's base row acquires "0" tokens status (by turning the token over) then they are able to move and jump any opponent's token in any direction multiplying to an even product.

What is claimed is:

1. A method of playing a board game comprising a game board divided into a plurality of squares forming rows and columns arranged with two unmarked rows of squares at each end of the board, called base rows, that at the start of the game accommodate two sets of consecutively marked tokens, one set of tokens differing in color from the other set, the base rows at one end being a first player's territory, the base rows at the other end being the other player's territory, and the middle portion of unmarked squares being open territory, the method comprising:

each player alternatingly moving a token wherein if an opponent's token is in a square forward, diagonally forward, or on a square to the sides of the token, the player may jump the opposing token only if the number on the token and the opponent's token multiply to an even number.

* * * * *